US009523962B2

(12) United States Patent
Maruyama et al.

(10) Patent No.: US 9,523,962 B2
(45) Date of Patent: Dec. 20, 2016

(54) ELECTRONIC TIMEPIECE

(71) Applicant: CASIO COMPUTER CO., LTD., Shibuya-ku, Tokyo (JP)

(72) Inventors: Hirohisa Maruyama, Fuchu (JP); Jyunichi Hirokawa, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/046,117

(22) Filed: Feb. 17, 2016

(65) Prior Publication Data

US 2016/0252885 A1 Sep. 1, 2016

(30) Foreign Application Priority Data

Feb. 27, 2015 (JP) ..... 2015-037853

(51) Int. Cl.
*G04G 9/00* (2006.01)
*G04R 20/14* (2013.01)

(52) U.S. Cl.
CPC ..... *G04G 9/0076* (2013.01); *G04R 20/14* (2013.01)

(58) Field of Classification Search
CPC ..... G04G 5/00; G04G 5/007; G04G 9/0076; G04R 20/14
See application file for complete search history.

(56) References Cited

U.S. PATENT DOCUMENTS 4,681,460 A * 7/1987 Nishimura ..... G04G 9/0076 368/21
5,007,033 A * 4/1991 Kubota ..... G04G 9/0076 368/21
5,319,581 A * 6/1994 Sakata ..... G06F 1/14 708/111
8,817,579 B2 * 8/2014 Scott ..... G04G 21/04 368/21
2003/0081507 A1 * 5/2003 Kitazawa ..... G04G 9/0076 368/21

FOREIGN PATENT DOCUMENTS

JP 2009118403 A 5/2009

* cited by examiner

*Primary Examiner* — Vit W Miska
(74) *Attorney, Agent, or Firm* — Holtz, Holtz & Volek PC

(57) ABSTRACT

An electronic timepiece that displays time based on city data related to the time of a city includes: a second home time storage area and a third world time storage area that store additional city data related to the time of an additional city transmitted from an external device; a storage area other than the second home time storage area and the third world time storage area; and a processing unit that clears the additional city data stored in the second home time storage area and the third world time storage area when selected data is switched from the additional city data stored in the second home time storage area and the third world time storage area to the city data stored in the storage area.

16 Claims, 11 Drawing Sheets

FIG. 6A

| 202 FIRST HOME TIME | 203 SECOND HOME TIME |
|---|---|
| (UNDETERMINED) | ◆ CITY C |

FIG. 6B

| 202 FIRST HOME TIME | 203 SECOND HOME TIME |
|---|---|
| CITY A | (CLEARED) |

FIG. 7A

| 302 FIRST WORLD TIME | 303 SECOND WORLD TIME | 304 THIRD WORLD TIME |
|---|---|---|
| (UNDETERMINED) | ◆ CITY B | ◆ CITY C |

FIG. 7B

| 302 FIRST WORLD TIME | 303 SECOND WORLD TIME | 304 THIRD WORLD TIME |
|---|---|---|
| CITY A | ◆ CITY B | (CLEARED) |

FIG. 8A

| 302 FIRST WORLD TIME | 303 SECOND WORLD TIME | 304 THIRD WORLD TIME |
|---|---|---|
| (UNDETERMINED) | ◆ CITY B | ◆ CITY C |

FIG. 8B

| 302 FIRST WORLD TIME | 303 SECOND WORLD TIME | 304 THIRD WORLD TIME |
|---|---|---|
| (UNDETERMINED) | ◆ CITY B | (CLEARED) |

FIG. 11A

| 202 FIRST HOME TIME | 203 SECOND HOME TIME | 302 FIRST WORLD TIME | 303 SECOND WORLD TIME | 304 THIRD WORLD TIME |
|---|---|---|---|---|
| CITY A | | UNDETERMINED | ◆CITY B | ◆CITY C |

FIG. 11B

| 202 FIRST HOME TIME | 203 SECOND HOME TIME | 302 FIRST WORLD TIME | 303 SECOND WORLD TIME | 304 THIRD WORLD TIME |
|---|---|---|---|---|
| | ◆CITY C | CITY A | ◆CITY B | (CLEARED) |

FIG. 12A

| 202 FIRST HOME TIME | 203 SECOND HOME TIME | 302 FIRST WORLD TIME | 303 SECOND WORLD TIME | 304 THIRD WORLD TIME |
|---|---|---|---|---|
| UNDETERMINED | ◆CITY D | CITY A | ◆CITY B | |

FIG. 12B

| 202 FIRST HOME TIME | 203 SECOND HOME TIME | 302 FIRST WORLD TIME | 303 SECOND WORLD TIME | 304 THIRD WORLD TIME |
|---|---|---|---|---|
| CITY A | (CLEARED) | UNDETERMINED | ◆CITY B | ◆CITY D |

FIG. 13A

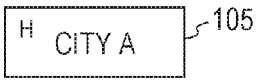

FIG. 13B

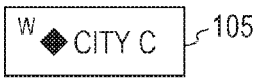

ELECTRONIC TIMEPIECE

BACKGROUND OF THE INVENTION

The present invention relates to an electronic timepiece.

In recent years, electronic timepieces have developed to have multiple functions. For example, it is known that some electronic timepieces have a world time function that can display the times of various cities in the world. A world time function of an electronic timepiece is a function of measuring the time in a predetermined time zone (Japan, for example) where standard electronic waves can be received as the home time, calculating the time of a selected city from the time difference information about the selected city stored in a storage unit and the measured home time when the selected city is selected from among the various cities in the world through a user operation, and displaying and outputting the calculated time of the selected city, for example.

JP 2009-118403 A, for example, discloses an electronic timepiece that is connected to an external device such as a smartphone through short-range wireless communication such as Bluetooth (a registered trade name), and corrects time in accordance with time information received from the external device.

Also, there is a known electronic timepiece that has a function of adding a city (called an additional city) other than the cities preset from an external device.

Meanwhile, some electronic timepieces having a world time function can perform switching between a home time and a world time. When the home time or the world time is changed from an additional city to a preset city in such an electronic timepiece, the additional city remains in a storage area, resulting in unnecessary memory.

The home time city switching and the world time city switching are performed by a user looking at a small display window formed on the clock face of the electronic timepiece. Therefore, if the number of additional cities becomes larger, the switching process becomes much more troublesome.

Further, if city switching from the home time to the world time is performed in a case where the time of an additional city is set as the home time, for example, the city whose time was added as the home time is changed to the city whose time is set as the world time. Here, "city switching" means switching the cities displayed on the main time display unit 11 and the sub time display unit 12.

From a viewpoint of a user, the city whose time was added as the home time is set as the world time, and therefore, it is not clear what has happened to the time of the city added as the home time.

SUMMARY OF THE INVENTION

To achieve the above object, the present invention provides an electronic timepiece that displays time based on city data related to the time of a city, the electronic timepiece including:

a storage device including: a first storage area storing additional city data among the city data, the additional city data being related to the time of an additional city transmitted from an external device; and a second storage area storing the city data other than the additional city data stored in the first storage area, the second storage area being a storage area other than the first storage area; and a processor that clears the additional city data stored in the first storage area when selected data is switched from the additional city data stored in the first storage area to the city data stored in the second storage area.

BRIEF DESCRIPTION OF THE DRAWINGS

FIGS. 6A and 6B are diagrams showing an example of data in a case where selective display is changed from a second home time to a first home time;

FIGS. 7A and 7B are diagrams showing an example of data in a case where selective display is changed from a third world time to a first world time;

FIGS. 8A and 8B are diagrams showing an example of data in a case where selective display is changed from the third world time to a second world time;

FIGS. 11A and 11B are diagrams showing an example of data in a process of switching between the first home time and the third world time;

FIGS. 12A and 12B are diagrams showing an example of data in a process of switching between the second home time and the first world time;

FIGS. 13A and 13B are diagrams showing display examples of city names according to the embodiment;

DETAILED DESCRIPTION

The following is a detailed description of modes for carrying out the present invention (the modes will be hereinafter referred to as "embodiments"), with reference to the accompanying drawings.

<<Structure of an Electronic Timepiece>>

Figure 1:
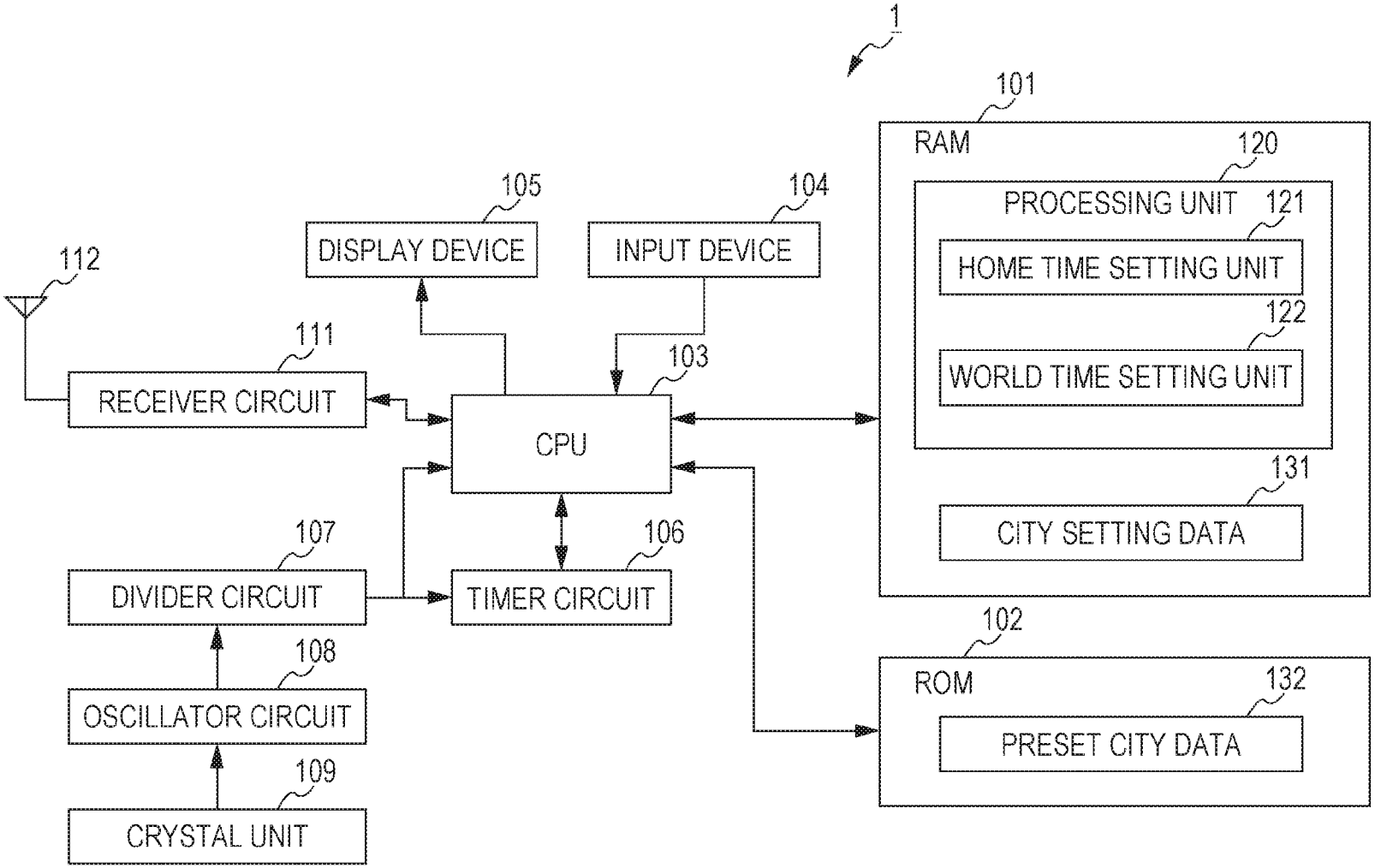
FIG. 1 is a functional block diagram showing the structure of an electronic timepiece according to an embodiment of the present invention.

FIG. 1 is a functional block diagram showing the structure of an electronic timepiece according to this embodiment.

An electronic timepiece 1 includes a RAM (Random Access Memory) 101, a ROM (Read Only Memory) 102, a CPU (Central Processing Unit) 103, a display device 105, and an input device 104.

A program (not shown) stored in the ROM 102 is loaded into the RAM 101 that provides the CPU 103 with a work memory space, and is executed by the CPU 103, to embody a processing unit 120, and a home time setting unit 121 and a world time setting unit 122 that constitute the processing unit 120.

The home time setting unit 121 performs a process related to home time setting. Here, the "home time" is the time displayed on a main time display unit 11 (FIG. 2) of the electronic timepiece 1.

The world time setting unit 122 performs a process related to world time setting. Here, the "world time" is the time of a different city from the city of the home time, and is set by a user operation or the like.

The processing unit 120, and the home time setting unit 121 and the world time setting unit 122, which constitute the processing unit 120, may be included in the CPU 103, or each may have an independent CPU or RAM to perform respective operations.

Further, city setting data 131 is stored (registered) in the RAM 101. The city setting data 131 is data about the cities whose times are set as the home time and the world time. The city setting data 131 will be described later.

Figure 2:
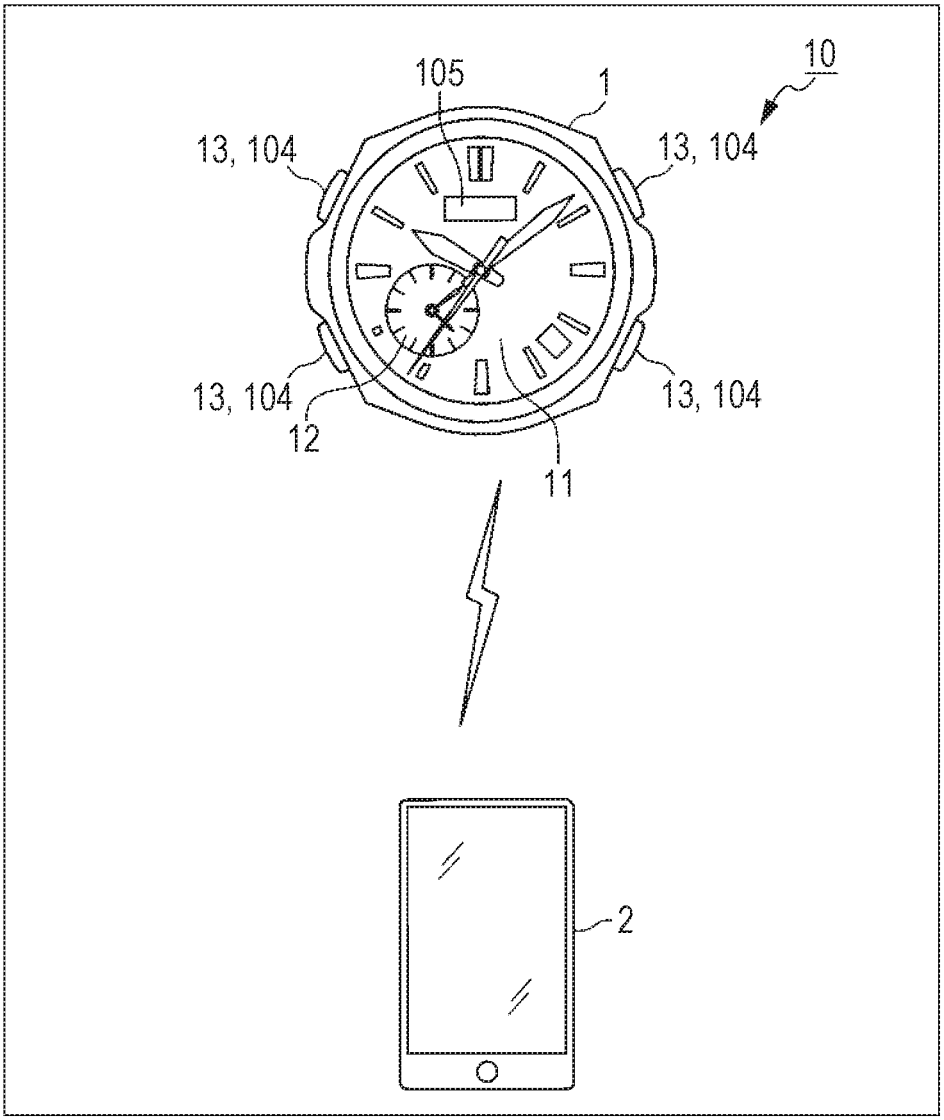
FIG. 2 is a diagram showing an example configuration of an electronic timepiece system according to the embodiment.

Preset city data 132 is stored in the ROM 102 that also stores the control program to be executed by the CPU 103 and control data. The preset city data 132 is data stored beforehand (at the time of shipment from the factory, for example) in the ROM 102, and is about the cities whose times can be selected as the home time and the world time. As will be described later, a user can set the times of cities stored in the preset city data 132 as the home time and the world time, and can also set an additional city transmitted from an external device 2 (FIG. 2).

In this embodiment, a table or the like that holds temperature correction values for a crystal unit 109 is stored in the ROM 102. However, this table is not shown in the drawings, and is not described in detail herein. Also, the table may be stored in a different memory (such as an EEPROM) from the ROM 102.

The display device 105 is a liquid crystal panel placed on the clock face, and displays the names of the cities that are set as the home time and the world time.

Information about home time setting and world time setting is input to the input device 104, and the processing unit 120 performs home time setting and world time setting in accordance with the information input to the input device 104.

The electronic timepiece 1 also includes the crystal unit 109, and an oscillator circuit 108 and a divider circuit 107 that generate a clock for measuring the current time. The electronic timepiece 1 further includes a timer circuit 106 that performs timing in accordance with a signal from the oscillator circuit 108 and the divider circuit 107/

The electronic timepiece 1 further includes an antenna 112 and a receiver circuit 111.

The antenna 112 receives a GPS (Global Positioning System) signal, and receives data transmitted from the external device 2. The receiver circuit 111 is a filter, a detector circuit, or the like.

Here, a time counter that measures time and date is provided in the timer circuit 106, and the value of the time counter is incremented by the clock from the divider circuit 107, so that the current time is measured. The GPS signal received by the receiver circuit 111 contains time information. If the value of the time information does not match the value of the time counter in the timer circuit 106, the counter value (the current time) is corrected. In this manner, accurate time display can be realized.

<<Configuration of an Electronic Timepiece System>>

FIG. 2 is a diagram showing an example configuration of an electronic timepiece system according to this embodiment.

An electronic timepiece system 10 includes the electronic timepiece 1 and the external device 2. Here, the external device 2 is a smartphone, a portable telephone, a PC (Personal Computer), or the like.

The electronic timepiece 1 and the external device 2 are connected by short-range wireless communication with Bluetooth (a registered trade name) or the like. Through this short-range wireless communication, city data other than the preset city data 132 (FIG. 1) is additionally supplied to the electronic timepiece 1 from the external device 2. The added city is called the "additional city", and the data about the added city is called the "additional city data".

The electronic timepiece 1 includes a main time display unit 11 that displays the home time, and a sub time display unit 12 that displays a world time. The electronic timepiece 1 has the display device 105 set on the clock face. The electronic timepiece 1 further includes push buttons 13 as the input device 104 at outer peripheral portions.

<<City Setting Data>>

Figure 3:
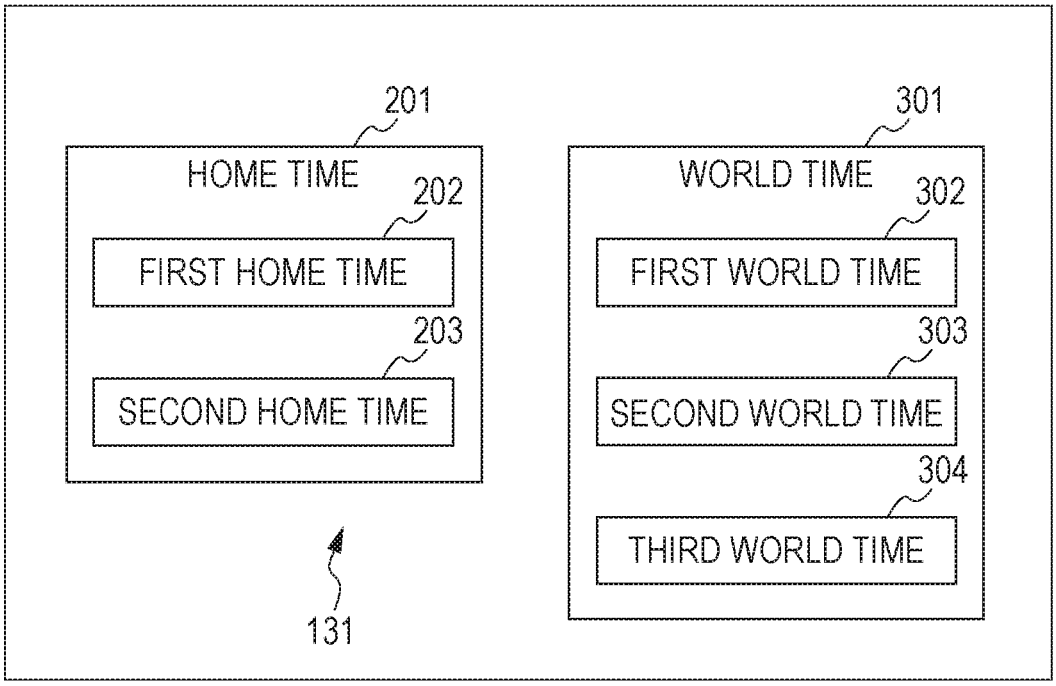
FIG. 3 is a diagram showing an example of city setting data according to the embodiment.

FIG. 3 is a diagram showing an example of city setting data according to this embodiment. In the description below, FIGS. 1 and 2 will also be referred to as necessary.

The city setting data 131 is formed with a home time storage area 201 and a world time storage area 301. The home time storage area 201 includes a first home time storage area 202 (a second storage area) and a second home time storage area 203 (a first storage area and a third storage area). Further, the world time storage area 301 includes a first world time storage area 302 (a second storage area), and a second world time storage area 303 and a third world time storage area 304 (a first storage area and a third storage area).

The first home time storage area 202 stores city data that has been selected from the preset city data 132 and been set. The city data stored in the first home time storage area 202 is set by a user mainly when communication with the external device 2 is not established.

The second home time storage area 203 stores additional city data. Additional city data is stored into the second home time storage area 203 in one of the manners described below.

(A1) When the electronic timepiece 1 is connected to the external device 2, the external device 2 senses the current position with a GPS or the like. The external device 2 then transmits additional city data about the current position to the electronic timepiece 1. The home time setting unit 121 of the electronic timepiece 1 stores the received additional city data as the second home time storage area 203, and causes the main time display unit 11 to display the time indicated by the additional city data stored in the second home time storage area 203.

(A2) A user manually causes the external device 2 to transmit additional city data. After the transmission of the additional city data, the same processing as that in (A1) is performed.

The first world time storage area 302 stores city data that has been selected from the preset city data 132 and been set.

The second world time storage area 303 and the third world time storage area 304 store additional city data. Unlike the additional city data stored in the third world time storage area 304 described later, the additional city data stored in the second world time storage area 303 can be changed or updated, but is preferably not to be cleared. With this, world time setting options can be maintained. The home time is normally the current time at the current location of the user. City data that was added in the past is basically unnecessary. If past city data remains, confusion might be caused. On the other hand, the world time is normally not the time at the current location of the user, and city data that was added in the past can remain without causing any problem.

In the initial state of the electronic timepiece 1, additional city data may be already stored in the second world time storage area 303. With this, the second world time storage area 303 is prevented from becoming "null", and it can be made clear that city data other than the preset city data 132 is stored in the second world time storage area 303.

In the third world time storage area 304, the additional city data that was stored in the second home time storage area 203 prior to a city switching process is stored.

Here, "city switching" means switching the cities displayed on the main time display unit 11 and the sub time display unit 12.

Each set of city data preferably includes a city number, a city code, a time difference, a summer time rule, data related to automatic switching on/off of daylight saving and utilization of daylight-saving time, and the like, but is not limited to such data content.

<<City Change>>

Referring now to FIGS. 4 through 8, a city change is described. In the description below, FIGS. 1 through 3 will also be referred to as necessary.

A city change means changing cities in the home time or world time.

[Flowcharts]

(Home Time Change Process)

Figure 4:
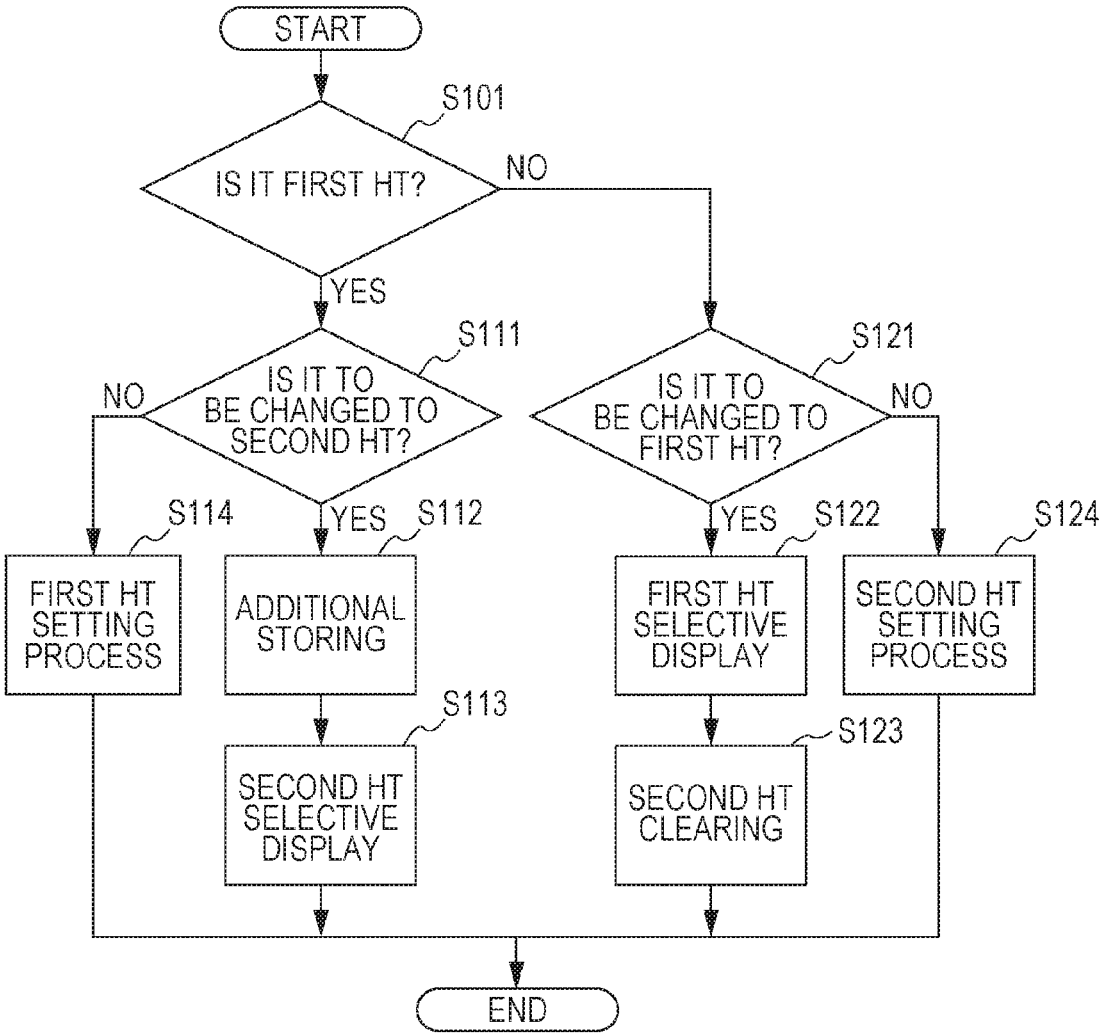
FIG. 4 is a flowchart showing the procedures in a city change process in the home time.

FIG. 4 is a flowchart showing the procedures in a city change process in the home time.

In each of the flowcharts in FIGS. 4, 5, 9, 10, 14, and 15, each home time is referred to as "HT", and each world time is referred to as "WT".

When the electronic timepiece 1 senses a connection to an external device, or a user inputs a home time change instruction through the input device 104, the process shown in FIG. 4 is started. Here, "a user inputs a home time change instruction through the input device 104" means that a user inputs a home time change instruction by operating one or more of the push buttons 13.

First, the home time setting unit 121 determines whether the selective display on the main time display unit 11 indicates a first home time (first HT) (S101). Here, the "selective display" is the data displayed as a time on the main time display unit 11 or the sub time display unit 12 among the data about the cities set in the city setting data 131. For example, in a case where the time of "city C", which is a second home time, is displayed on the main time display unit 11, it is described as "the second home time is selectively displayed as the home time". Likewise, in a case where the time of "city C", which is a third world time, is displayed on the sub time display unit 12, it is described as "the third world time is selectively displayed as the world time".

If the result of step S101 indicates that the selective display on the main time display unit 11 indicates the first home time (Yes in S101), the home time setting unit 121 determines whether the selective display on the main time display unit 11 is to be changed to the second home time (second HT) (S111).

If the result of step S111 indicates that the selective display on the main time display unit 11 is to be changed to the second home time (Yes in S111), the home time setting unit 121 additionally stores additional city data into the second home time storage area 203 (S112). The additional city data is additionally stored, as the additional city data is transmitted from the external device 2 to the electronic timepiece 1. It should be noted that the result of step S111 becomes "Yes" when the electronic timepiece 1 senses a connection to the external device 2, for example.

The home time setting unit 121 then selectively displays the additional city data additionally stored into the second home time storage area 203 (second HT selective display: S113). That is, the time displayed on the main time display unit 11 is changed to the time of the additional city indicated by the additional city data stored in the second home time storage area 203.

At this point, the home time setting unit 121 may put the first home time storage area 202 into an "undetermined" or "null" state.

As the first home time storage area 202 that is not selectively displayed is put into an "undetermined" state, memory can be saved.

If the result of step S111 indicates that the selective display on the main time display unit 11 is not to be changed to the second home time (No in S111), the home time setting unit 121 performs a first home time setting process (S114).

The first home time setting process includes the processes described below.

(B1) The home time setting unit 121 updates the city data in the first home time storage area 202. After that, the home time setting unit 121 selectively displays, on the main time display unit 11, the time of the city indicated by the city data stored in the first home time storage area 202. If the first home time storage area 202 is "undetermined" at this point, the user selects the city of the first home time through the input device 104 (by operating the push buttons 13).

(B2) The home time setting unit 121 ends the city change process while maintaining the current city data in the first home time storage area 202. In this case, the time selectively displayed on the main time display unit 11 does not change.

If the result of step S101 indicates that the selective display on the main time display unit 11 is not the first home time (No in S101), or if the selective display on the main time display unit 11 indicates the second home time, the home time setting unit 121 determines whether the selective display on the main time display unit 11 is to be changed to the first home time (S121).

If the result of step S121 indicates that the selective display on the main time display unit 11 is to be changed to the first home time (Yes in S121), the home time setting unit 121 selectively displays the city data stored in the first home time storage area 202 (first HT selective display: S122). That is, the time displayed on the main time display unit 11 is changed to the time of the city indicated by the city data stored in the first home time storage area 202. If the city data in the first home time storage area 202 is "undetermined" at the point of step S122, the home time setting unit 121 selects the city of the first home time based on the current location or the like.

The home time setting unit 121 then clears the additional city data stored in the second home time storage area 203 (second HT clearing: S123). It should be noted that "clearing" means freeing the corresponding memory area in the RAM 101 (FIG. 1).

In this manner, generation of an unnecessary memory area can be prevented. Also, as the selection of world times can be narrowed, user friendliness can be increased.

If the result of step S121 indicates that the selective display on the main time display unit 11 is not to be changed to the first home time (No in S121), the home time setting unit 121 performs a second home time setting process (S124).

The second home time setting process includes the processes described below.

(C1) The home time setting unit 121 updates the additional city data in the second home time storage area 203. After that, the home time setting unit 121 selectively displays, on the main time display unit 11, the time of the additional city indicated by the additional city data stored in the second home time storage area 203. If the second home time storage area 203 is "null" at this point, the additional city data is transmitted from the external device 2 to the electronic timepiece 1.

(C2) The home time setting unit 121 ends the city change process while maintaining the current additional city data in the second home time storage area 203. In this case, the time selectively displayed on the main time display unit 11 does not change.

(World Time Change Process)

Figure 5:
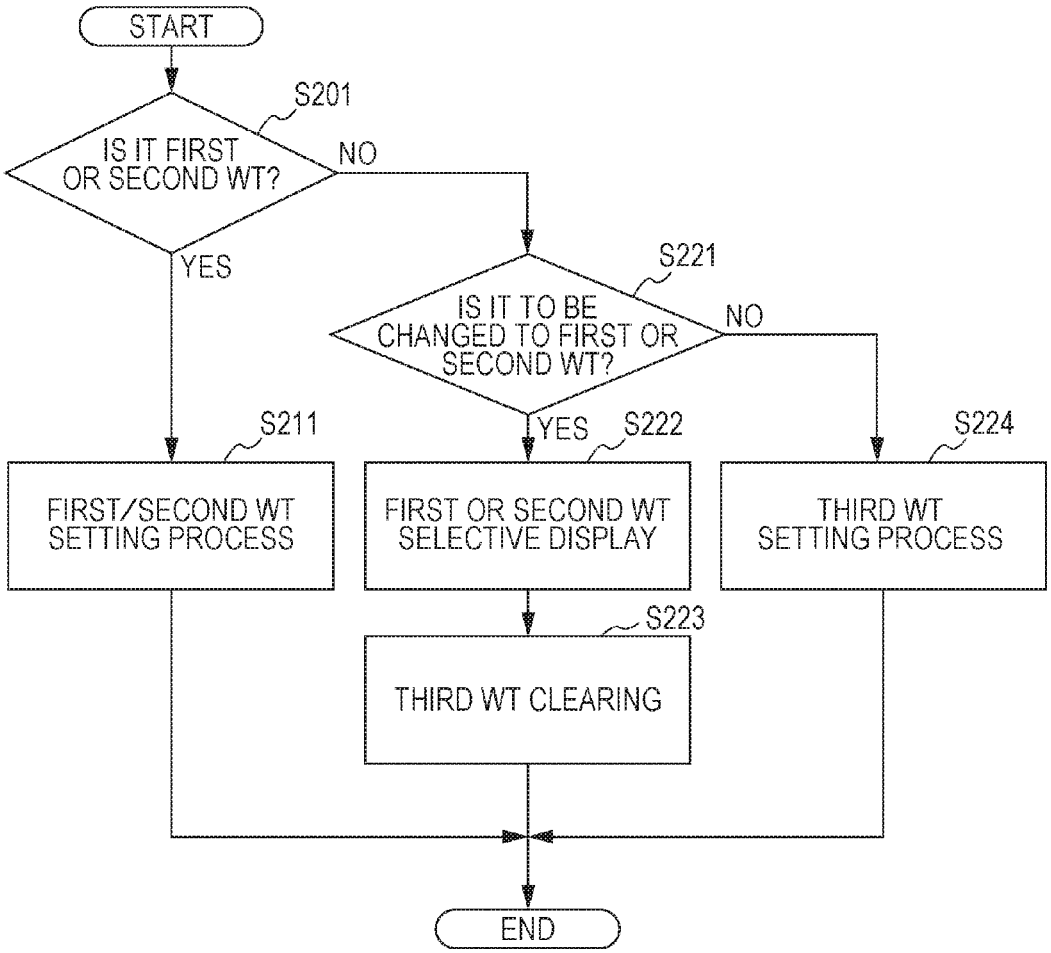
FIG. 5 is a flowchart showing the procedures in a city change process in the world time.

FIG. 5 is a flowchart showing the procedures in a city change process in the world time.

When the electronic timepiece 1 senses a connection to an external device, or a user inputs a world time change instruction through the input device 104, the process shown in FIG. 5 is started. Here, "a user inputs a world time change instruction through the input device 104" means that a user inputs a world time change instruction by operating the push buttons 13.

First, the world time setting unit 122 determines whether the selective display on the sub time display unit 12 indicates a first world time (first WT) or a second world time (second WT) (S201).

If the result of step S201 indicates that the selective display on the sub time display unit 12 indicates the first world time or the second world time (Yes in S201), the world time setting unit 122 performs a first/second world time setting process (S211).

The first/second world time setting process includes the processes described below.

(D1) The world time setting unit 122 updates the city data in the first world time storage area 302. After that, the world time setting unit 122 selectively displays, on the sub time display unit 12, the time of the city indicated by the city data stored in the first world time storage area 302. If the city data in the first world time storage area 302 is "undetermined" at this point, the world time setting unit 122 selects the city of the first world time based on the current location or the like.

(D2) The world time setting unit 122 additionally stores additional city data into the second world time storage area 303. After that, the world time setting unit 122 selectively displays, on the sub time display unit 12, the time of the additional city indicated by the additional city data stored in the second world time storage area 303. If the second world time storage area 303 is "null" at this point, the additional city data is transmitted from the external device 2 to the electronic timepiece 1.

(D3) The world time setting unit 122 ends the city change process while maintaining the current city data in the first world time storage area 302.

(D4) The world time setting unit 122 ends the city change process while maintaining the current additional city data in the second world time storage area 303.

(D5) The world time setting unit 122 changes the selective display on the sub time display unit 12 from the first world time to the second world time. That is, the world time setting unit 122 changes the time displayed on the sub time display unit 12 from the time of the city indicated by the city data stored in the first world time storage area 302 to the time of the additional city indicated by the additional city data stored in the second world time storage area 303. At this point, the world time setting unit 122 may put the first world time storage area 302 into an "undetermined" state. As the first world time storage area 302 that is not selectively displayed is put into an "undetermined" state, memory can be saved. If the second world time storage area 303 is "null" at this point, the additional city data is transmitted from the external device 2 to the electronic timepiece 1.

(D6) The world time setting unit 122 additionally stores the transmitted additional city data into the second world time storage area 303, and changes the selective display on the sub time display unit 12 from the first world time to the second world time. That is, the world time setting unit 122 changes the time displayed on the sub time display unit 12 from the time of the city indicated by the city data stored in the first world time storage area 302 to the time of the additional city indicated by the additional city data stored in the second world time storage area 303. At this point, the world time setting unit 122 may put the first world time storage area 302 into an "undetermined" state. As the first world time storage area 302 that is not selectively displayed is put into an "undetermined" state, memory can be saved. If the second world time storage area 303 is "null" at this point, the external device 2 transmits the additional city data to the electronic timepiece 1.

(D7) The world time setting unit 122 changes the selective display on the sub time display unit 12 from the second world time to the first world time. That is, the world time setting unit 122 changes the time displayed on the sub time display unit 12 from the time of the additional city indicated by the additional city data stored in the second world time storage area 303 to the time of the city indicated by the city data stored in the first world time storage area 302. If the city data in the first world time storage area 302 is "undetermined" at this point, the world time setting unit 122 selects the city of the first world time based on the current location or the like.

If the result of step S201 indicates that the selective display on the sub time display unit 12 indicates neither the first world time nor the second world time (No in S201), the selective display on the sub time display unit 12 indicates the third world time. The world time setting unit 122 then determines whether the selective display on the sub time display unit 12 is to be changed to the first world time or the second world time (S221).

If the result of step S221 indicates that the selective display on the sub time display unit 12 is to be changed to the first world time or the second world time (Yes in S221), the world time setting unit 122 selectively displays the city data stored in the first world time storage area 302 or the additional city data stored in the second world time storage area 303 (first WT or second WT selective display: S222). That is, the time displayed on the sub time display unit 12 is changed to the time of the city indicated by the city data stored in the first world time storage area 302 or to the time of the additional city indicated by the additional city data stored in the second world time storage area 303. In a case where the first world time is selectively displayed in step S222, if the city data in the first world time storage area 302 is undetermined, the user selects the city of the first world time through the input device 104 (by operating the push buttons 13). Likewise, in a case where the second world time is selectively displayed in step S222, if the second world time storage area 303 is "null", the external device 2 transmits additional city data to the electronic timepiece 1. The world time setting unit 122 then additionally stores the transmitted additional city data into the second world time storage area 303.

The world time setting unit 122 then clears the additional city data stored in the third world time storage area 304 (third WT clearing: S223).

In this manner, generation of an unnecessary memory area can be prevented. Also, as the selection of world times can be narrowed, user friendliness can be increased.

If the result of step S221 indicates that the selective display on the sub time display unit 12 is not to be changed to the first world time or the second world time (No in S221), a third world time setting process is performed (S224).

The third world time setting process includes the processes described below.

(E1) The world time setting unit 122 updates the additional city data in the third world time storage area 304. After that, the world time setting unit 122 selectively displays, on the sub time display unit 12, the time of the additional city indicated by the additional city data stored in the third world time storage area 304. If the third world time storage area 304 is "null" at this point, the additional city data is transmitted from the external device 2 to the electronic timepiece 1.

(E2) The world time setting unit 122 ends the city change process while maintaining the current additional city data in the third world time storage area 304. In this case, the time selectively displayed on the sub time display unit 12 does not change.

[Specific Examples of City Data Changes]

Referring now to FIGS. 6A through 8B, specific examples of data in city change processes are described. The description below concerns example cases where the additional city data in the second home time storage area 203 and the third world time storage area 304, which is the feature of this embodiment, is cleared, and other examples will not be described.

In FIGS. 6A through 8B, the data indicated by shaded portions is data that is selectively displayed.

The unfilled data indicates that the data is "null". Also, "(undetermined)" means "not selected", or "null". Here, an "undetermined" state is a state where any preset city data 132 is not selected for the first home time or the first world time. An "undetermined" state is the same as a "null" state. In the first home time storage area 202 or the first world time storage area 302, the term "undetermined" is used to emphasize that the already stored preset city data 132 is to be input thereto. On the other hand, the additional city data to be stored into the second home time storage area 203, the second world time storage area 303, and the third world time storage area 304 are not necessarily stored in the electronic timepiece 1, and therefore, the term "null" is used therein.

FIGS. 6A and 6B are diagrams showing an example of data in a case where selective display is changed from the second home time to the first home time.

Prior to the switching, the city setting state is as shown in FIG. 6A. Specifically, the "city C" stored in the second home time storage area 203 is selectively displayed, and the first home time storage area 202 is in an "undetermined" state. It should be noted that the "◆" displayed beside "city C" means that this city data is additional city data.

FIG. 6A shows the home time storage area 201 in a situation where the result of step S101 is "No" and the result of step S121 is "Yes" in FIG. 4.

If "city A" is selectively displayed as the first home time in this situation, the data changes as shown in FIG. 6B.

FIG. 6B shows the home time storage area 201 in a situation where the result of step S101 is "No", the result of step S121 is "Yes", and steps S122 and S123 have been completed in FIG. 4.

In FIG. 6B, the city data of the "city A" is stored into the first home time storage area 202, and the first home time is selectively displayed. The additional city data of the "city C" in the second home time storage area 203 is then cleared. Here, "clearing" means freeing the corresponding memory area in the RAM 101 (FIG. 1).

FIGS. 7A and 7B are diagrams showing an example of data in a case where selective display is changed from the third world time to the first world time.

Prior to the switching, the city setting state is as shown in FIG. 7A. Specifically, the "city C" stored in the third world time storage area 304 is selectively displayed, and the first world time storage area 302 is in an "undetermined" state. In the second world time storage area 303, "city B" is stored as additional city data.

FIG. 7A shows the world time storage area 301 in a situation where the result of step S201 is "No" and the result of step S221 is "Yes" (a change to the first world time) in FIG. 5.

If "city A" is selectively displayed as the first world time in this situation, the data changes as shown in FIG. 7B.

FIG. 7B shows the world time storage area 301 in a situation where the result of step S201 is "No", the result of step S221 is "Yes" (a change to the first world time), and steps S222 and S223 have been completed in FIG. 5.

In FIG. 7B, the city data of the "city A" is stored into the first world time storage area 302, and the first world time is selectively displayed. The additional city data of the "city C" in the third world time storage area 304 is then cleared.

FIGS. 8A and 8B are diagrams showing an example of data in a case where selective display is changed from the third world time to the second world time.

Prior to the switching, the city setting state is as shown in FIG. 8A. Specifically, the "city C" stored in the third world time storage area 304 is selectively displayed, and the first world time storage area 302 is in an "undetermined" state. In the second world time storage area 303, "city B" is stored as additional city data.

FIG. 8A shows the world time storage area 301 in a situation where the result of step S201 is "No" and the result of step S221 is "Yes" (a change to the second world time) in FIG. 5.

FIG. 8B shows the world time storage area 301 in a situation where the result of step S201 is "No", the result of step S221 is "Yes" (a change to the second world time), and steps S222 and S223 have been completed in FIG. 5.

If "city B" is selectively displayed as the second world time in FIG. 8A, the data changes as shown in FIG. 8B.

That is, the "city B" stored in the second world time storage area 303 is selectively displayed, and the additional city data of the "city C" in the third world time storage area 304 is cleared.

<<City Switching>>

[Flowcharts]

Figure 9:
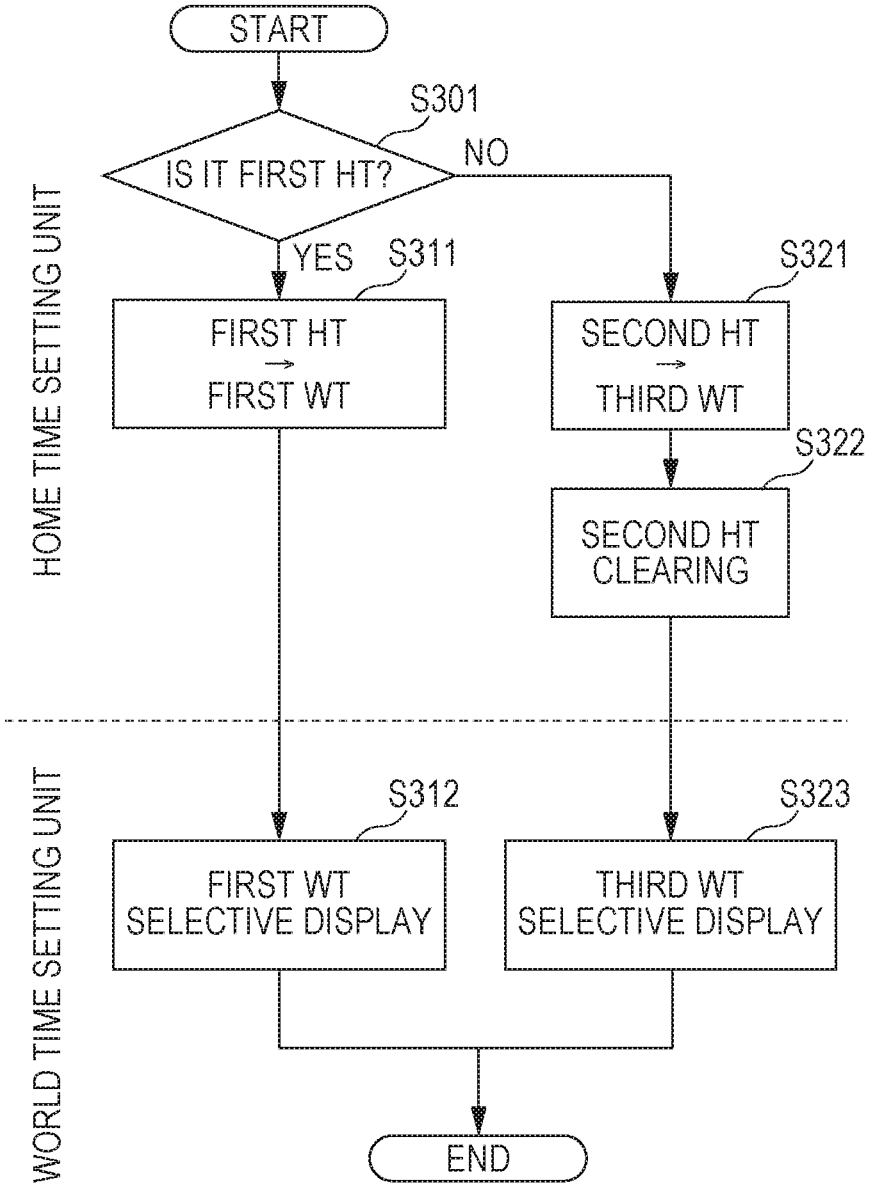
FIG. 9 shows the process to be performed when the city selectively displayed as the home time is selectively displayed as the world time in a city switching process.
Figure 10:
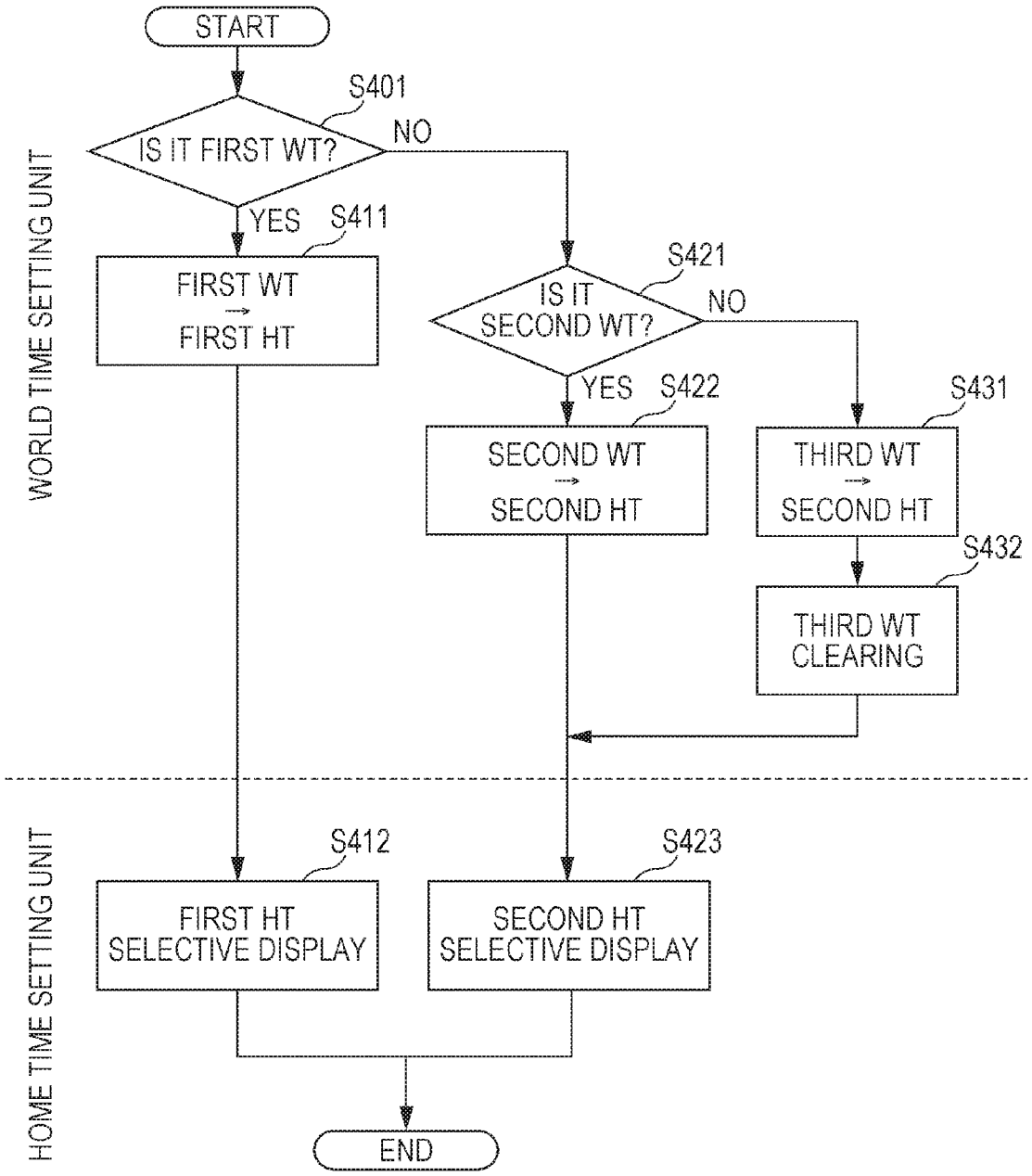
FIG. 10 shows the process to be performed when the city selectively displayed as the world time is selectively displayed as the home time in a city switching process.

Referring now to FIGS. 9 and 10, the procedures in city switching processes according to this embodiment are described. Although the city switching processes described below are divided into the process shown in FIG. 9 and the process shown in FIG. 10 in this embodiment, the process shown in FIG. 9 and the process shown in FIG. 10 are processes to be performed in parallel, with the use of a temporary file or the like. In the description below, FIGS. 1 and 3 will also be referred to as necessary.

(Switching from Home Time to World Time)

FIG. 9 shows the process to be performed when the city selectively displayed as the home time is selectively displayed as the world time in a city switching process.

When a user inputs a city switching instruction through the input device 104, the process shown in FIG. 9 is started. Here, "a user inputs a city switching instruction through the input device 104" means that a user inputs a city switching instruction by operating the push buttons 13.

First, the home time setting unit 121 determines whether the home time currently displayed as selective display on the main time display unit 11 is the first home time (first HT) (S301).

If the result of step S301 indicates that the current selective display on the main time display unit 11 indicates the first home time (Yes in S301), the home time setting unit 121 stores the city data stored in the first home time storage area 202 (first HT) into the first world time storage area 302 (first WT) (first HT to first WT: S311). At this point, the home time setting unit 121 may put the first home time storage area 202 into an "undetermined" state.

As the first home time storage area 202 that is not selectively displayed is put into an "undetermined" state, memory can be saved. The "undetermined" state will be described later.

The world time setting unit 122 then selectively displays the city data stored in the first world time storage area 302 as the world time (first WT selective display: S312). That is, the time displayed on the sub time display unit 12 is changed to the time of the city indicated by the city data stored in the first world time storage area 302.

If the result of step S301 indicates that the selective display on the main time display unit 11 does not indicate the first home time (No in S301), the home time setting unit 121 stores the additional city data stored in the second home time storage area 203 (second HT) into the third world time storage area 304 (third WT) (second HT to third WT: S321). The home time setting unit 121 then clears the additional city data stored in the second home time storage area 203 (second HT clearing: S322).

In this manner, generation of an unnecessary memory area can be prevented. Also, as the selection of world times can be narrowed, user friendliness can be increased.

The world time setting unit 122 then selectively displays the additional city data stored in the third world time storage area 304 as the world time (third WT selective display: S323). That is, the time displayed on the sub time display unit 12 is changed to the time of the additional city indicated by the additional city data stored in the third world time storage area 304.

(Switching from World Time to Home Time)

FIG. 10 shows the process to be performed when the city selectively displayed as the world time is selectively displayed as the home time in a city switching process.

When a user inputs a city switching instruction through the input device 104, the process shown in FIG. 10 is started. The "a user inputs a city switching instruction through the input device 104" means that a user inputs a city switching instruction by operating the push buttons 13.

First, the world time setting unit 122 determines whether the current selective display on the sub time display unit 12 indicates the first world time (first WT) (S401).

If the result of step S401 indicates that the current selective display on the sub time display unit 12 indicates the first world time (Yes in S401), the world time setting unit 122 stores the city data stored in the first world time storage area 302 (first WT) into the first home time storage area 202 (first HT) (first WT to first HT: S411). At this point, the world time setting unit 122 may put the first world time storage area 302 into an "undetermined" state.

As the first world time storage area 302 that is not selectively displayed is put into an "undetermined" state, memory can be saved.

The home time setting unit 121 then selectively displays the city data stored in the first home time storage area 202 as the home time (first HT selective display: S412). That is, the time displayed on the main time display unit 11 is changed to the time of the city indicated by the city data stored in the first home time storage area 202.

If the result of step S401 indicates that the current selective display on the sub time display unit 12 does not indicate the first world time (No in S401), the world time setting unit 122 determines whether the current selective display on the sub time display unit 12 indicates the second world time (second WT) (S421).

If the result of step S421 indicates that the current selective display on the sub time display unit 12 indicates the second world time (Yes in S421), the world time setting unit 122 stores the additional city data stored in the second world time storage area 303 (second WT) into the second home time storage area 203 (second HT) (second WT to second HT: S422).

The home time setting unit 121 then selectively displays the additional city data stored in the second home time storage area 203 as the home time (second HT selective display: S423). That is, the time displayed on the main time display unit 11 is changed to the time of the additional city indicated by the additional city data stored in the second home time storage area 203.

If the result of step S421 indicates that the current selective display on the sub time display unit 12 does not indicate the second world time (No in S421), the world time currently displayed as selective display is the third world time. Therefore, the world time setting unit 122 stores the additional city data stored in the third world time storage area 304 (third WT) into the second home time storage area 203 (second HT) (third WT to second HT: S431).

The world time setting unit 122 then clears the additional city data stored in the third world time storage area 304 (third WT clearing: S432).

In this manner, generation of an unnecessary memory area can be prevented. Also, as the selection of world times can be narrowed, user friendliness can be increased.

The home time setting unit 121 then selectively displays the additional city data stored in the second home time storage area 203 as the home time (second HT selective display: S423). That is, the time displayed on the main time display unit 11 is changed to the time of the additional city indicated by the additional city data stored in the second home time storage area 203.

[Specific Examples of Data in City Switching]

FIGS. 11A through 12B are diagrams showing specific examples of data in city switching processes. The description below concerns example cases where the additional city data in the second home time storage area 203 and the third world time storage area 304, which is the feature of this embodiment, is cleared, and other examples will not be described.

In FIGS. 11A through 12B, the data indicated by shaded portions is data that is selectively displayed. Also, in FIGS. 11A through 12B, the reference numerals are the same as those used in FIG. 3, and therefore, explanation of them is not repeated herein.

FIGS. 11A and 11B are diagrams showing an example of data in a process of switching between the first home time and the third world time.

Prior to the switching, the city setting state is as shown in FIG. 11A.

FIG. 11A shows the home time storage area 201 and the world time storage area 301 in a situation where the result of step S401 is "No" and the result of step S421 is "No" in FIG. 10.

Here, the data indicated by shaded portions is data that is selectively displayed. That is, on the electronic timepiece 1, the time displayed as the home time is the time of "city A", and the time displayed as the world time is the time of "city C". Also, "◆" that is displayed beside each city name is the symbol indicating an additional city.

The unfilled data indicates that the data is "null". Also, "(undetermined)" means "not selected".

When switching between the home time and the world time is performed in this situation, the city setting data 131 changes as shown in FIG. 11B.

FIG. 11B shows the home time storage area 201 and the world time storage area 301 in a situation where the result of step S401 is "No", the result of step S421 is "No", and steps S431, S432, and S423 have been completed in FIG. 10.

That is, the city data of "city A" that is stored in the first home time storage area 202 in FIG. 11A is stored into the first world time storage area 302. This is because "city A" is a preset city.

Also, "city C" that is stored in the third world time storage area 304 in FIG. 11A is an additional city, and therefore, the additional city data of "city C" is stored into the second home time storage area 203.

The additional city data stored in the third world time storage area 304 prior to the city switching (FIG. 11A) is then cleared.

FIGS. 12A and 12B are diagrams showing an example of data in a process of switching between the second home time and the first world time.

Prior to the switching, the city setting state is as shown in FIG. 12A.

FIG. 12A shows the home time storage area 201 and the world time storage area 301 in a situation where the result of step S301 is "No" in FIG. 9.

On the electronic timepiece 1, the time displayed as the home time is the time of "city D", and the time displayed as the world time is the time of "city A".

When switching between the home time and the world time is performed in this situation, the city setting data 131 changes as shown in FIG. 12B.

FIG. 12B shows the home time storage area 201 and the world time storage area 301 in a situation where the result of step S301 is "No", and steps S321, S322, and S323 have been completed in FIG. 9.

That is, the additional city data of "city D" that is stored in the second home time storage area 203 in FIG. 12A is stored into the third world time storage area 304.

Also, "city A" that is stored in the first world time storage area 302 is a preset city, and therefore, the city data of "city A" is stored into the first home time storage area 202.

The additional city data stored in the second home time storage area 203 prior to the city switching (FIG. 12A) is then cleared.

[Display Examples]

FIGS. 13A and 13B are diagrams showing display examples of city names according to this embodiment.

As shown in FIGS. 13A and 13B, either "H" or "W" is displayed on the display device 105. "H" shown in FIG. 13A means the home time, and the city currently displayed in the display window is the city that is set as the city of the home time.

Likewise, "W" shown in FIG. 13B means the world time, and the city currently displayed in the display window is the city that is set as the city of the world time.

When "◆" is displayed beside the city name as shown in FIG. 13B, the city is an additional city.

[Other Embodiments]

Figure 14:
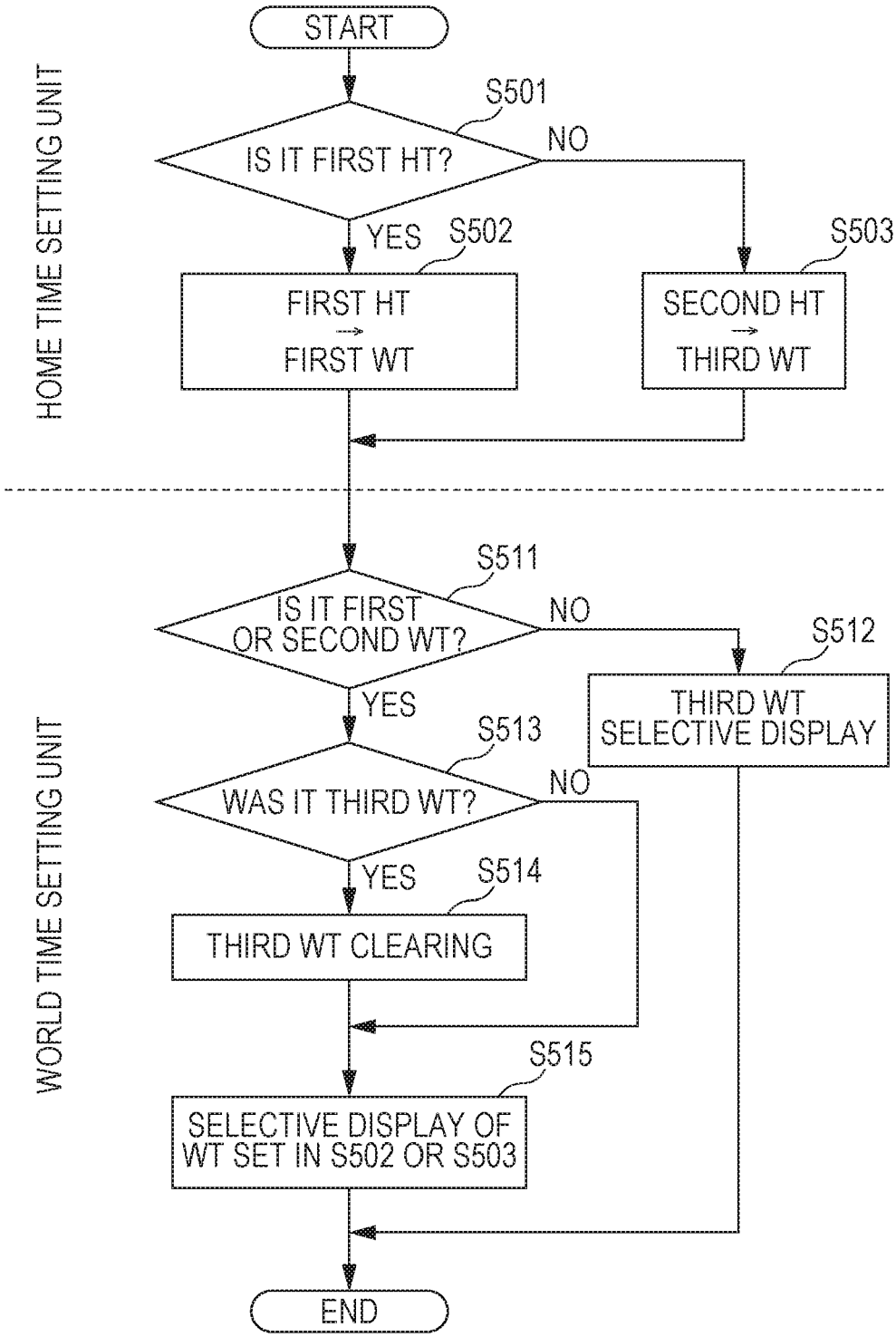
FIG. 14 shows the process to be performed when the city selectively displayed as the home time is selectively displayed as the world time in a city switching process.
Figure 15:
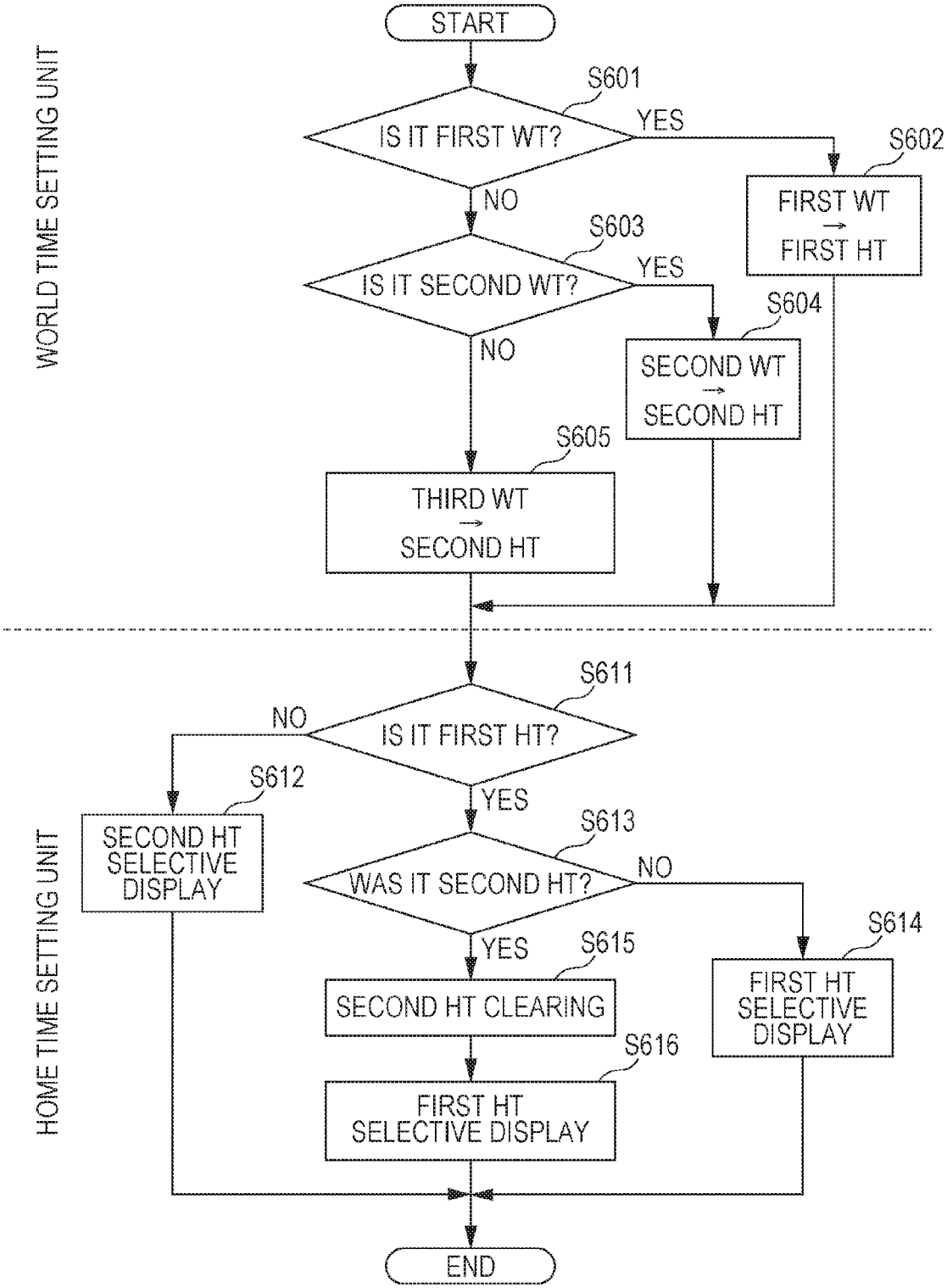
FIG. 15 shows the process to be performed when the city selectively displayed as the world time is selectively displayed as the home time in a city switching process.

Referring now to FIGS. 14 and 15, city switching processes according to another embodiment are described. In the description below, FIGS. 1 and 3 will also be referred to as necessary. Although the processes in FIGS. 14 and 15 are shown in separate flowcharts, but these processes are preferably performed in parallel.

(Switching from Home Time to World Time)

FIG. 14 shows the process to be performed when the city selectively displayed as the home time is selectively displayed as the world time in a city switching process.

When a user inputs a city switching instruction through the input device 104, the process shown in FIG. 14 is started. The "a user inputs a city switching instruction through the input device 104" means that a user inputs a city switching instruction by operating the push buttons 13.

First, the home time setting unit 121 determines whether the current selective display on the main time display unit 11 indicates the first home time (S501).

If the result of step S501 indicates that the current selective display on the main time display unit 11 indicates the first home time (Yes in S501), the home time setting unit 121 stores the city data stored in the first home time storage area 202 into the first world time storage area 302 (first HT to first WT: S502). After that, the processing unit 120 moves on to step S511.

If the result of step S501 indicates that the current selective display on the main time display unit 11 does not indicate the first home time (No in S501), the home time currently displayed as the selective display is the second home time. Therefore, the home time setting unit 121 stores the additional city data stored in the second home time storage area 203 into the third world time storage area 304 (second HT to third WT: S503). After that, the processing unit 120 moves on to step S511.

The world time setting unit 122 then determines whether the time of the city designated to be selectively displayed on the sub time display unit 12 through the input device 104 is set as the first world time or the second world time (S511). That is, the world time setting unit 122 determines whether the city data of the city designated to be selectively displayed on the sub time display unit 12 is stored in the first world time storage area 302 or the second world time storage area 303.

If the result of S511 indicates that time of the designated city is not set as the first world time or the second world time (No in S511), the time of the city designated to be selectively displayed is the time of the city set as the third world time. Therefore, the world time setting unit 122 selectively displays the time of the city set as the third world time (third WT selective display: S512). That is, the time displayed on the sub time display unit 12 is changed to the time of the additional city indicated by the additional city data stored in the third world time storage area 304.

If the result of step S511 indicates that the time of the designated city is set as the first world time or the second world time (Yes in S511), the world time setting unit 122 determines whether the world time displayed before the city switching instruction was issued is the third world time (S513). That is, the world time setting unit 122 determines whether the selective display on the sub time display unit 12 before the city switching instruction was issued indicated the third world time.

If the result of step S513 indicates that the world time displayed before the city switching instruction was issued is not the third world time (No in S513), the world time setting unit 122 selectively displays the world time that has been set in step S502 or S503 (S515). That is, in a case where step S502 has been carried out, the time displayed on the sub time display unit 12 is changed to the time of the city indicated by the city data stored in the first world time storage area 302. In a case where step S503 has been carried out, the time displayed on the sub time display unit 12 is changed to the time of the additional city indicated by the additional city data stored in the third world time storage area 304.

If the result of step S513 indicates that the world time displayed before the city switching instruction was issued is the third world time (Yes in S513), the world time setting unit 122 clears the third world time storage area 304 (third WT clearing: S514).

In this manner, generation of an unnecessary memory area can be prevented. Also, as the selection of world times can be narrowed, user friendliness can be increased.

The world time setting unit 122 then selectively displays the world time that has been set in step S502 or S503 (S515). That is, in a case where step S502 has been carried out, the time displayed on the sub time display unit 12 is changed to the time of the city indicated by the city data stored in the first world time storage area 302. In a case where step S503 has been carried out, the time displayed on the sub time display unit 12 is changed to the time of the additional city indicated by the additional city data stored in the third world time storage area 304.

(Switching from Home Time to World Time)

FIG. 15 shows the process to be performed when the city selectively displayed as the world time is selectively displayed as the home time in a city switching process.

When a user inputs a city switching instruction through the input device 104, the process shown in FIG. 15 is started. The "a user inputs a city switching instruction through the input device 104" means that a user inputs a city switching instruction by operating the push buttons 13.

First, the world time setting unit 122 determines whether the current selective display on the sub time display unit 12 indicates the first world time (S601).

If the result of step S601 indicates that the current selective display on the sub time display unit 12 indicates the first world time (Yes in S601), the world time setting unit 122 stores the city data currently stored in the first world time storage area 302 into the first home time storage area 202 (first WT to first HT: S602). After that, the processing unit 120 moves on to step S611.

If the result of step S601 indicates that the current selective display on the sub time display unit 12 does not indicate the first world time (No in S601), the world time setting unit 122 determines whether the current selective display on the sub time display unit 12 indicates the second world time (S603).

If the result of step S603 indicates that the current selective display on the sub time display unit 12 indicates the second world time (Yes in S603), the world time setting unit 122 stores the additional city data stored in the second world time storage area 303 into the second home time storage area 203 (second WT to second HT: S604). After that, the processing unit 120 moves on to step S611.

If the result of step S603 indicates that the current selective display on the sub time display unit 12 does not indicate the second world time (No in S603), the world time currently displayed as selective display is the third world time. Therefore, the world time setting unit 122 stores the additional city data stored in the third world time storage area 304 into the second home time storage area 203 (third WT to second HT: S605). After that, the processing unit 120 moves on to step S611.

The home time setting unit 121 then determines whether the time of the city designated to be selectively displayed as the home time on the main time display unit 11 through the input device 104 is set as the first home time (S611). That is, the home time setting unit 121 determines whether the city data of the city designated to be selectively displayed as the home time on the main time display unit 11 through the input device 104 is stored in the first home time storage area 202. It should be noted that "through the input device 104" means that "the user operating the push buttons 13", for example.

If the result of step S611 indicates that the time of the designated city is not set as the first home time (No in S611), the time of the city designated to be selectively displayed is the time that is set as the second home time. Therefore, the home time setting unit 121 selectively displays the time of the city set as the second home time (second HT selective display: S612). That is, the time displayed on the main time display unit 11 is changed to the time of the additional city indicated by the additional city data stored in the second home time storage area 203.

If the result of step S611 indicates that the time of the designated city is set as the first home time (Yes in S611), the home time setting unit 121 determines whether the home time selectively displayed before the city switching instruction was issued is the second time (S613). That is, the home time setting unit 121 determines whether the city data of the city designated to be selectively displayed as the home time on the main time display unit 11 through the input device 104 is stored in the second home time storage area 203. It should be noted that "through the input device 104" means that "the user operating the push buttons 13", for example.

If the result of step S613 indicates that the home time displayed before the city switching instruction was issued is not the second home time (No in S613), the home time setting unit 121 selectively displays the home time that is set as the first home time (first HT selective display: S614). That is, the time displayed on the main time display unit 11 is changed to the time of the city indicated by the city data stored in the first home time storage area 202.

If the result of step S613 indicates that the home time displayed before the city switching instruction was issued is the second home time (Yes in S613), the home time setting unit 121 clears the second home time storage area 203 (second HT clearing: S615).

In this manner, generation of unnecessary memory area can be prevented. Also, as the selection of home times can be narrowed, user friendliness can be increased.

The home time setting unit 121 then selectively displays the time of the city that is set as the first home time (first HT selective display: S616). That is, the time displayed on the main time display unit 11 is changed to the time of the city indicated by the city data stored in the first home time storage area 202.

According to this embodiment, when selective display is switched from the second home time storage area 203 or the third world time storage area 304 to another storage area, the second home time storage area 203 or the third world time storage area 304, whichever has been selectively displayed, is cleared. In this manner, generation of an unnecessary memory area can be eliminated. Also, as the selection of home times can be narrowed, user friendliness at a time when the city is checked with the small display device 105 can be increased.

It should be noted that additional city data may not be transmitted through the external device 2. Instead, additional city data may be transmitted from a server of a company or the like via a telephone line or the like.

Communication between the electronic timepiece 1 and the external device 2 may be established not necessarily with short-range wireless communication such as Bluetooth (a registered trade name), but with a cable connection such as a USB (Universal Serial Bus) or with a wireless LAN (Local Area Network).

The second world time storage area 303 may be eliminated.

On the contrary, two or more second world time storage areas 303 may be provided.

Further, in this embodiment, the city whose time is set as the second world time may be updated but is not to be cleared. However, the second world time may function like the second home time. That is, the second world time storage area 303 may store not only additional city data transmitted from the external device 2 but also the data of the additional city whose time is set as the second home time in a city switching process.

The electronic timepiece 1 may display only the home time. In such a case, only the process shown in FIG. 4 is performed.

When disconnected from the external device 2, the processing unit 120 may immediately conduct selective display of the first home time as the home time and the first world time as the world time, and clear the second home time storage area 203 and the third world time storage area 304. By doing so, the processing unit 120 can narrow down the selectable city data to the preset city data 132 when disconnected from the external device 2.

The invention claimed is:

1. An electronic timepiece that displays time based on city data related to time of a city, the electronic timepiece comprising:

a storage device including: a first storage area storing additional city data among the city data, the additional city data being related to a time of an additional city transmitted from an external device; and a second storage area storing the city data other than the additional city data stored in the first storage area, the second storage area being a storage area other than the first storage area; and a processor configured to clear the additional city data stored in the first storage area when selected data is switched from the additional city data stored in the first storage area to the city data stored in the second storage area.

2. The electronic timepiece according to claim 1, wherein the additional city data stored in the first storage area is related to a home time, the home time being a time in a region where the electronic timepiece is located, the city data stored in the second storage area is related to the home time, and the processor controls the additional city data and the city data related to the home time, and clears the additional city data stored in the first storage area when selected data is switched from the additional city data stored in the first storage area to the city data stored in the second storage area.

3. The electronic timepiece according to claim 1, wherein the additional city data stored in the first storage area is related to a world time, the world time being a time outside a region where the electronic timepiece is located, the city data stored in the second storage area is related to the world time, and the processor controls the additional city data and the city data related to the world time, and clears the additional city data stored in the first storage area when selected data is switched from the additional city data stored in the first storage area to the city data stored in the second storage area.

4. The electronic timepiece according to claim 2, wherein the additional city data stored in the first storage area is related to a world time, the world time being a time outside the region where the electronic timepiece is located, the city data stored in the second storage area is related to the world time, and the processor controls the additional city data and the city data related to the world time, and clears the additional city data stored in the first storage area when selected data is switched from the additional city data stored in the first storage area to the city data stored in the second storage area.

5. The electronic timepiece according to claim 1, wherein a third storage area is formed in the storage device, additional city data related to a time of an additional city being stored into the third storage area at a world time, the additional city data being transmitted from the external device, and the processor moves the additional city data stored in the first storage area at a home time indicating a time in a region where the electronic timepiece is located into the third storage area at the world time, and clears the additional city data stored in the first storage area.

6. The electronic timepiece according to claim 2, wherein a third storage area is formed in the storage device, additional city data related to a time of an additional city being stored into the third storage area at a world time, the additional city data being transmitted from the external device, and the processor moves the additional city data stored in the first storage area at the home time indicating the time in the region where the electronic timepiece is located into the third storage area at the world time, and clears the additional city data stored in the first storage area.

7. The electronic timepiece according to claim 3, wherein a third storage area is formed in the storage device, additional city data related to a time of an additional city being stored into the third storage area at the world time, the additional city data being transmitted from the external device, and the processor moves the additional city data stored in the first storage area at a home time indicating the time in the region where the electronic timepiece is located into the third storage area at the world time, and clears the additional city data stored in the first storage area.

8. The electronic timepiece according to claim 4, wherein a third storage area is formed in the storage device, additional city data related to a time of an additional city being stored into the third storage area at the world time, the additional city data being transmitted from the external device, and the processor moves the additional city data stored in the first storage area at the home time indicating the time in the region where the electronic timepiece is located into the third storage area at the world time, and clears the additional city data stored in the first storage area.

9. The electronic timepiece according to claim 1, wherein a third storage area is formed in the storage device, additional city data related to a time of an additional city being stored into the third storage area at a home time indicating a time in a region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

10. The electronic timepiece according to claim 2, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

11. The electronic timepiece according to claim 3, wherein a third storage area is formed in the storage device, additional city data related to a time of an additional city being stored into the third storage area at a home time indicating a time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

12. The electronic timepiece according to claim 4, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

13. The electronic timepiece according to claim 5, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

14. The electronic timepiece according to claim 6, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

15. The electronic timepiece according to claim 7, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

16. The electronic timepiece according to claim 8, wherein a third storage area is formed in the storage device, additional city data related to a time of an additional city being stored into the third storage area at the home time indicating the time in the region where the electronic timepiece is located, the additional city data being transmitted from the external device, and the processor moves the additional city data stored in the first storage area at the home time into the third storage area at a world time indicating a time outside the region where the electronic timepiece is located, and clears the additional city data stored in the first storage area.

* * * * *